US007083044B1

(12) United States Patent
Kilian et al.

(10) Patent No.: US 7,083,044 B1
(45) Date of Patent: Aug. 1, 2006

(54) DEEP-SET PAINT PAN WITH A FORM FITTED LID

(76) Inventors: Richard Kilian, 4113 Grosvenor La., Salida, CA (US) 95368; William Stockburger, 4113 Grosvenor La., Salida, CA (US) 95368

( * ) Notice: Subject to any disclaimer, the term of this patent is extended or adjusted under 35 U.S.C. 154(b) by 232 days.

(21) Appl. No.: 10/732,749

(22) Filed: Dec. 9, 2003

(51) Int. Cl.
*B65D 69/00* (2006.01)

(52) U.S. Cl. ..... 206/229; 206/349; 206/361; 220/570; 15/257.06

(58) Field of Classification Search ..... 206/209, 206/229, 349, 361; 220/570, 735; 15/256.06, 15/257.06
See application file for complete search history.

(56) References Cited

U.S. PATENT DOCUMENTS 1,595,965 A * 8/1926 Johnson ..... 15/104.001
2,521,122 A * 9/1950 Lambourne ..... 15/257.06
2,901,098 A * 8/1959 Tupper ..... 220/270
3,828,389 A * 8/1974 Heisler ..... 15/257.06
3,850,298 A * 11/1974 Jolly ..... 206/349
4,200,949 A * 5/1980 Heniff, Jr. ..... 15/257.6
4,445,250 A * 5/1984 Seidl ..... 15/257.06
4,541,542 A * 9/1985 Florentino ..... 220/570
4,547,926 A * 10/1985 Kern ..... 15/257.06
4,651,379 A * 3/1987 Kern ..... 15/257.06
4,802,576 A * 2/1989 Kern ..... 206/225
5,178,274 A * 1/1993 Long ..... 206/361
5,316,137 A * 5/1994 Kyllonen ..... 206/209
5,489,042 A * 2/1996 Ewald ..... 220/573
5,511,279 A * 4/1996 Ippolito ..... 15/257.06
5,533,228 A * 7/1996 Jarecki et al. ..... 15/257.06
5,553,701 A * 9/1996 Jarecki et al. ..... 206/15.2
5,966,772 A * 10/1999 Woodnorth et al. ..... 15/230.11
2003/0015532 A1* 1/2003 Rickman et al. ..... 220/212
2004/0238399 A1* 12/2004 Billado, Jr. ..... 206/564

* cited by examiner

*Primary Examiner*—David T. Fidei
(74) *Attorney, Agent, or Firm*—Michael I Kroll

(57) ABSTRACT

The present invention 10 discloses a deep-set paint tray 22 having a cover 24 with a lip 32 positioned on the periphery for engaging the lip 26 of the deep-set paint roller pan 22. The deep-set paint roller pan 22 has a depth on the shallow end exceeding the diameter of a paint roller handle 34 thereby providing means for positioning a paint roller 18 within the tray prior to sealing the cover 24 to the tray. The flexible cover 24 provides means whereby air can be expelled from the interior by pressing on the middle of the cover as the cover is snapped onto the deep-set paint roller pan lip 26. The present invention 10 eliminates the need to clean the pan 22 and the roller 18 intermittently during a painting job. In addition, the pan 22 and roller 18 are more environmentally friendly because the pan and roller do not need to be cleaned since the cover 24 hermetically seals to the deep-set paint roller pan, therefore enabling the paint 14 to be stored with the roller in the tray for extended periods of time.

6 Claims, 8 Drawing Sheets

DEEP-SET PAINT PAN WITH A FORM FITTED LID

BACKGROUND OF THE INVENTION

1. Field of the Invention

The present invention relates generally to painting equipment and, more specifically, to a deep-set paint roller pan and lid. The deep-set paint tray has a cover with a lip positioned on the periphery for engaging the lip of the deep-set paint roller pan. The deep-set paint roller pan has a depth on the shallow end exceeding the diameter of a paint roller handle thereby providing means for positioning a paint roller within the tray prior to sealing the cover to the tray. The flexible lid provides means whereby air can be expelled from the interior by pressing on the middle of the cover as the cover is snapped onto the deep-set paint roller pan lip. The present invention eliminates the need to clean the pan and roller intermittently during a painting job. In addition, the pan and roller are more environmentally friendly because the pan and roller do not need to be cleaned since the lid hermetically seals to the deep-set paint roller pan therefore enabling the paint to be stored with the roller in the tray for extended periods of time.

2. Description of the Prior Art

There are other paint tray devices designed for rollers. Typical of these is U.S. Pat. No. 1,595,965 issued to Johnson on Aug. 10, 1926.

Another patent was issued to Heisler on Aug. 13, 1974 as U.S. Pat. No. 3,828,389. Yet another U.S. Pat. No. 3,850,298 was issued to Jolly on Nov. 26, 1974 and still yet another was issued on May 6, 1980 to Heniff, Jr. as U.S. Pat. No. 4,200,949.

Another patent was issued to Seidl on May 1, 1984 as U.S. Pat. No. 4,445,250. Yet another U.S. Pat. No. 4,541,542 was issued to Florentino on Sep. 17, 1985. Another was issued to Kern on Oct. 22, 1985 as U.S. Pat. No. 4,547,926 and still yet another was issued on Mar. 24, 1987 to Kern as U.S. Pat. No. 4,651,379.

Another patent was issued to Kern on Feb. 7, 1989 as U.S. Pat. No. 4,802,576. Yet another U.S. Pat. No. 5,316,137 was issued to Kyllonen on May 31, 1994. Another was issued to Jarecki, et al. on Jul. 9, 1996 as U.S. Pat. No. 5,533,228 and still yet another was issued on Sep. 10, 1996 to Jarecki, et al. as U.S. Pat. No. 5,553,701.

U.S. Pat. No. 1,595,965

Inventor: Moser E. Johnson

Issued: Aug. 10, 1926

A roller for applying enamel and the like, comprising a fixed spindle having a head at one end and a handle threaded on the other end, a cylindrical rotatable sleeve on the spindle-engaging the said head, a jam nut on the spindle engaging the handle and the other end of the sleeve and roller body of soft composition cast on the sleeve.

U.S. Pat. No. 3,828,389

Inventor: Raymond A. Heisler

Issued: Aug. 13, 1974

This invention pertains to a unitary container preferably generally rectangular in configuration. This container has one side or panel portion thereof hinged to the remainder of the container. This side or panel portion of the container is configured so that in its open condition there is provided a rimmed tray which may be used as a paint storage tray such as used with rollers and the like. The rim portion of the tray type side portion is adapted to fit within the rectangular remaining portion of the container. This remaining portion of the container provides the storage area. There is provided also an engaging tongue and groove portion which provides the seal of the container after initial use. The container in its initial condition has outwardly extending flange portions which are sealed to each other to provide a hermetic and fluid-tight seal of the container for storage, shipping and to prevent unwanted tempering U.S. Pat. No. 3,850,298

Inventor: James D. Jolly

Issued: Nov. 26, 1974

A combination carrying and storage case is disclosed comprising a hollow plastic shell member defining a lower inclined compartment and an upper horizontal compartment that are interconnected and extend from each other at an obtuse angle. The shell is formed of first and second side walls connected by a curved envelope with the upper half of the horizontal chamber including a pivotal closure member including portions of the side wall and the envelope and including a T-shaped handle-leg extending downwardly from adjacent one end of the horizontal chamber to support that end of the chamber and for use as a handle for carrying the container.

U.S. Pat. No. 4,200,949

Inventor: William V. Heniff, Jr.

Issued: May 6, 1980

A container for storing a quantity of paint and a roller-type paint applicator wherein a pair of plate-like members are mounted in vertically extending, spaced relation in the receptacle portion of the container by a pair of elongated, laterally spaced mounting members which extend horizontally through openings in the side walls of the container and upper ends of the plate-like members. A plurality of coil springs interconnect the plate-like members and bias the plate-like members toward each other with sufficient force, when engaged with the roller of the applicator, to support the roller in an elevated position above the level of paint in the receptacle portion when the applicator is not in use. The plate-like members also wipe excess paint from the roller as the latter is shifted upwardly between the members after being immersed in paint. A portion of the frame of the applicator extends through an opening in the cover of the container. The cover also serves to support the applicator in an upright position in the container when the applicator is not in use.

U.S. Pat. No. 4,445,250

Inventor: Allen W. Seidl

Issued: May 1, 1984

The invention is a paint case. A paint case comprising: a first paint tray having a shallow front portion sloping gradually to a deeper back portion, said first paint tray also having a hinge pin mounted on its exterior back surface; and a second paint tray of similar shape and depth as said first tray, aligned vertically and with its interior facing the interior of said first tray, said second tray having hinge pin hook means mounted on its exterior back surface and capable of engaging said hinge pin mounted on said first tray so as to allow said paint case to be closed and opened and said paint trays to be separated; said second tray also having a handle and lip catch release means mounted on its exterior front U.S. Pat. No. 4,541,542

Inventor: Gregory Florentino

Issued: Sep. 17, 1985

An improved paint tray cover for a paint tray including a generally rectangular surface extending over the four (4) sides of the paint tray. The surface has a wedge-shaped and longitudinal spatial protrusion preformed along a center line of the surface to accommodate the handle of a paint brush in the tray. The cover is designed to securely attach to the paint tray.

U.S. Pat. No. 4,547,926

Inventor: Gilbert G. Kern

Issued: Oct. 22, 1985

Paint roller tray has closed bottom and sides which terminate in upper periphery. Hinged cover seals against the periphery of the sides to exclude air to inhibit drying of the paint. Preferably, the cover has retainers on the inside for holding paint rollers and/or brushes which have been used with the paint in the tray so that those painting implements also do not dry out. The cover is hinged on the tray so that it is quickly available for closing.

U.S. Pat. No. 4,651,379

Inventor: Gilbert G. Kern

Issued: Mar. 24, 1987

Paint roller tray has generally rectangular closed bottom and sides which terminate in upper periphery. Hinged cover seals against the periphery of the sides to exclude air to inhibit drying of the paint. Preferably, the cover has retainers on the inside for holding paint rollers and/or brushes so that those painting implements also do not dry out. An interior sloped roller plate provides a roller operating area, without reducing interior volume.

U.S. Pat. No. 4,802,576

Inventor: Ingo Kern

Issued: Feb. 7, 1989

A storage container for a paint roller including a paint applying roll and a handle, the paint roller storage container surrounding the roller on all sides and having a housing provided with a recess for the paint roller, wherein a further recess for a roll of foil is provided next to the paint-applying roll within or outside of the container, the foil recess extending parallel to the paint-applying roll. When the inventive container is closed, it hermetically seals the paint-applying roll.

U.S. Pat. No. 5,316,137

Inventor: Glenn F. Kyllonen

Issued: May 31, 1994

A paint roller tray and lid having a seal for resealable air-tight mating of the tray with the lid. The lid has a paint roller handle holder so that when the lid is mated onto the tray the paint roller handle is detachably securable to the lid. The holder for holding a paint roller handle has a pair of resilient protrusions depending from the interior of the paint roller handle housing of the lid, the protrusions being in spaced apart relation so as to snugly receive therebetween a paint roller handle. The housing has contiguous sides extending upward from the upper surface of the lid and a roof extending between the contiguous sides. The protrusions depend from the roof into the housing, each of the resilient protrusions having therein a finger or thumb receptacle for insertion of a finger or thumb into the receptacle from the top of the housing whereby when a finger and a thumb are placed into the receptacles and a paint roller handle is detachably secured between the protrusions, the protrusions may be resiliently deformed so as to grip the paint roller handle between the protrusions.

U.S. Pat. No. 5,533,228

Inventor: James J. Jarecki, et al.

Issued: Jul. 9, 1996

A resealable paint tray assembly composed of a lid and tray formed as separate components and means for locking the lid to the tray to prevent skin forming on paint left for extended periods in the tray, the tray having a smooth uninterrupted inside and outside surface, the tray assembly having a brush rest section usable only when the tray assembly is open and in use.

U.S. Pat. No. 5,553,701

Inventor: James J. Jarecki, et al.

Issued: Sep. 10, 1996

A paint tray assembly consisting of a paint tray and a separate cover which is attached to and removed from the tray by mating peripheral ribs on the underside of the lid and the top edge of the tray, and a paint kit composed of the tray assembly and a paint pad, the lid having a recess for receiving in loose, confining relationship a portion of the paint pad so that the paint kit can be suspended vertically or displayed horizontally with the paint pad always being retained in a relatively fixed relationship with the lid and tray. While these paint trays may be suitable for the purposes for which they were designed, they would not be as suitable for the purposes of the present invention, as hereinafter described.

SUMMARY OF THE PRESENT INVENTION

The present invention discloses a deep-set paint tray having a cover with a lip positioned on the periphery for engaging the lip of the deep-set paint roller pan. The deep-set paint roller pan has a depth on the shallow end exceeding the diameter of a paint roller handle thereby providing means for positioning a paint roller within the tray prior to sealing the cover to the tray. The flexible cover provides means whereby air can be expelled from the interior by pressing on the middle of the cover as the cover is snapped onto the deep-set paint roller pan lip. The present invention eliminates the need to clean the pan and the roller intermittently during a painting job. In addition, the pan and roller are more environmentally friendly because the pan and roller do not need to be cleaned since the cover hermetically seals to the deep-set paint roller pan, therefore enabling the paint to be stored with the roller in the tray for extended periods of time.

A primary object of the present invention is to provide a deep-set paint pan and engaging lid.

Another object of the present invention is to provide a deep-set paint pan having means for engaging a lid.

Yet another object of the present invention is to provide a deep-set paint pan having a flanged rim.

Still yet another object of the present invention is to provide a deep-set paint pan having means for supporting the handle of a paint roller.

Another object of the present invention is to provide a deep-set paint pan having a cantilevered support on the shallow end.

Yet another object of the present invention is to provide a lid from the group of polymeric or elastomeric materials.

Still yet another object of the present invention is to provide a lid having a channel peripherally positioned therein.

Another object of the present invention is to provide a lid for engaging the deep-set paint tray.

Yet another object of the present invention is to provide a lid for engaging the top most rim of the deep-set paint tray and hermetically sealing the contents therein.

Still yet another object of the present invention is to provide a deep-set paint tray and engaging lid that will eliminate the need to intermittently clean the tray and roller during periods of non-use.

Another object of the present invention is to provide a deep-set paint tray and engaging lid that can be used to store paint until needed.

Yet another object of the present invention is to provide a deep-set paint tray and engaging lid that will reduce the amount of paint wasted due to intermittent cleaning of the tray and roller.

Still yet another object of the present invention is to provide a deep-set paint tray and lid that will reduce the amount of labor needed to perform a painting task.

Another object of the present invention is to provide a deep-set paint tray and lid that is easy to use.

Additional objects of the present invention will appear as the description proceeds.

The present invention overcomes the shortcomings of the prior art by providing a deep-set paint roller pan and lid. The deep-set paint tray has a cover with a lip positioned on the periphery for engaging the lip of the deep-set paint roller pan. The deep-set paint roller pan has a depth on the shallow end exceeding the diameter of a paint roller handle thereby providing means for positioning a paint roller within the tray prior to sealing the cover to the tray. The flexible lid provides means whereby air can be expelled from the interior by pressing on the middle of the cover as the cover is snapped onto the deep-set paint roller pan lip. The present invention eliminates the need to clean the pan and roller intermittently during a painting job. In addition, the pan and roller are more environmentally friendly because the pan and roller do not need to be cleaned since the lid hermetically seals to the deep-set paint roller pan therefore enabling the paint to be stored with the roller in the tray for extended periods of time.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
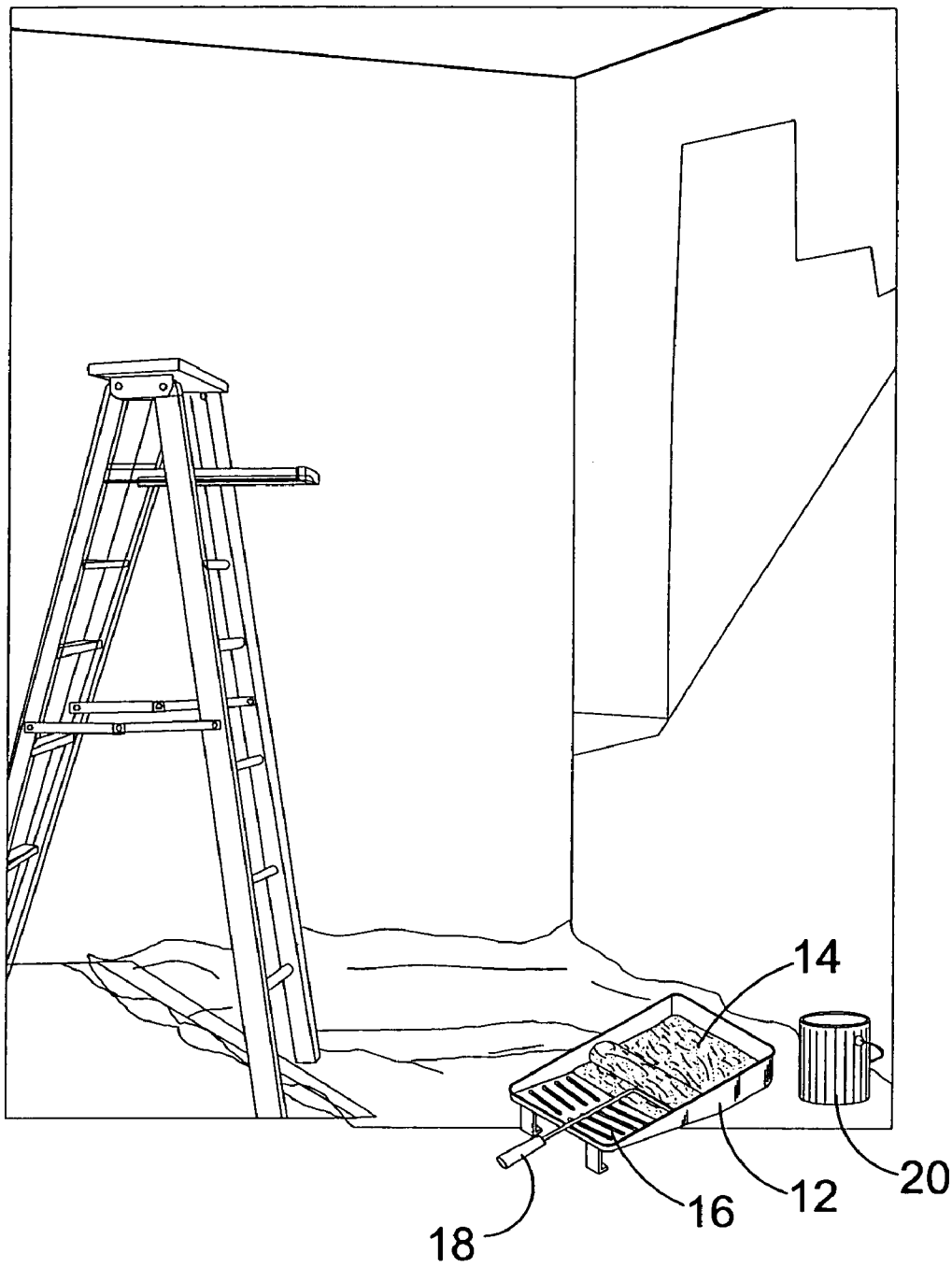
FIG. 1 is an illustrative view of the prior art.

With regard to reference numerals used, the following numbering is used throughout the drawings.

10 present invention
12 conventional roller pan
14 paint
16 platform of tray
18 roller
20 paint can
22 roller pan
24 cover
26 pan lip
28 shallow end
30 handle flange
32 cover lip
34 handle of roller

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the prior art. Shown is a typical conventional paint roller pan 12 having a quantity of paint 14 therein. Because the paint can dry quickly on the walls of the tray 12, tray platform 16 and paint roller 18, any extended absence requires the roller to be cleaned and the contents of the tray to be returned to the paint can 20 and the tray cleaned thoroughly thereby increasing the amount of time and labor needed to paint when using a roller.

Figure 2:
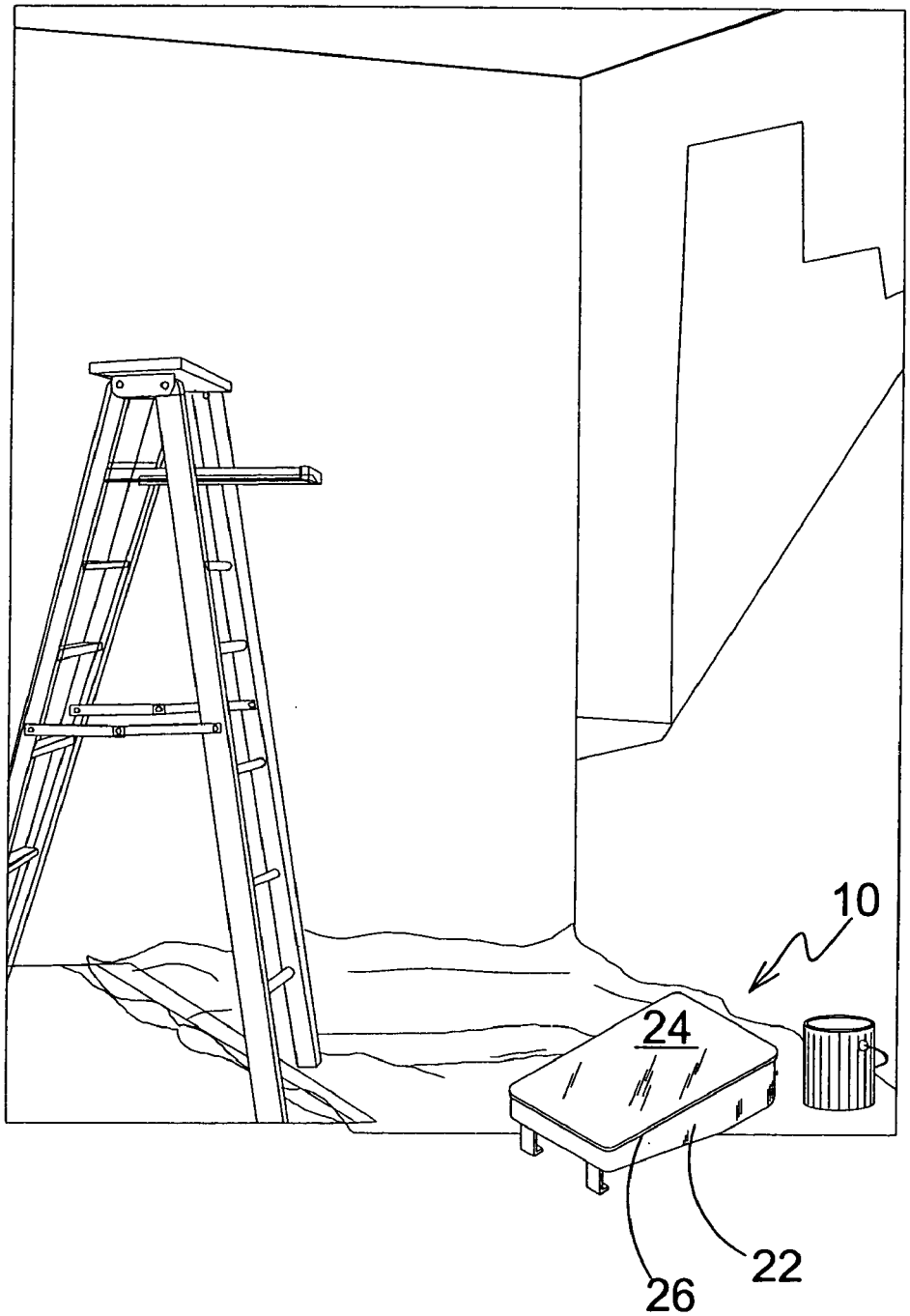
FIG. 2 is an illustrative view of the present invention in use.

Turning to FIG. 2, shown therein is an illustrative view of the present invention 10 in use. Shown is a paint tray 22 of the present invention 10 having a covering 24 with a lip positioned on the periphery thereof for engaging the lip 26 of the deep-set paint roller pan. The deep-set paint roller pan 22 has a depth on the shallow end exceeding the diameter of a paint roller handle thereby providing means for positioning a paint roller within the tray prior to sealing the cover 24 to the tray. Additional air can be expelled from the interior by pressing on the middle of the cover 24 as the cover is snapped onto the deep-set paint roller pan lip 26. The present invention 10 eliminates the need to clean the pan 22 and roller intermittently during a painting job. In addition, the pan 22 and roller are more environmentally friendly because the pan and roller do not need to be cleaned since the lid hermetically seals to the deep-set paint roller pan therefore enabling the paint to be stored with the roller in the tray for extended periods of time.

Figure 3:
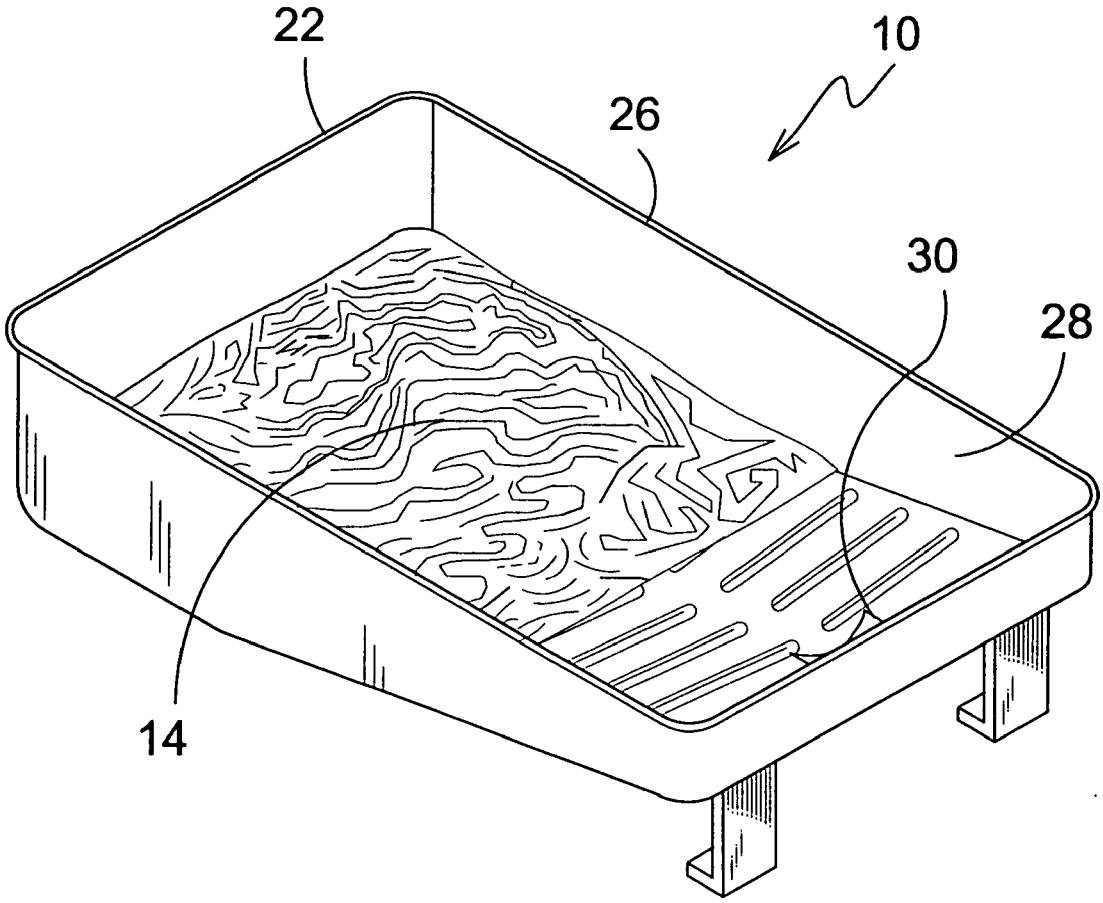
FIG. 3 is a perspective view of the deep-set paint pan of the present invention.

Turning to FIG. 3, shown therein is a perspective view of the deep-set paint pan 22 of the present invention 10. The deep-set paint pan 22 has peripheral walls with a lip 26 positioned thereon for engaging the cover. Also positioned on the interior wall on the shallow end 28 is a concave flange 30 forming a prop for the handle tip during paint pan cover usage. The flange 30 provides means for keeping the handle out of the paint 14 and is positioned such that the apex of the handle does not protrude above the planar surface of the paint pan rim 26.

Figure 4:
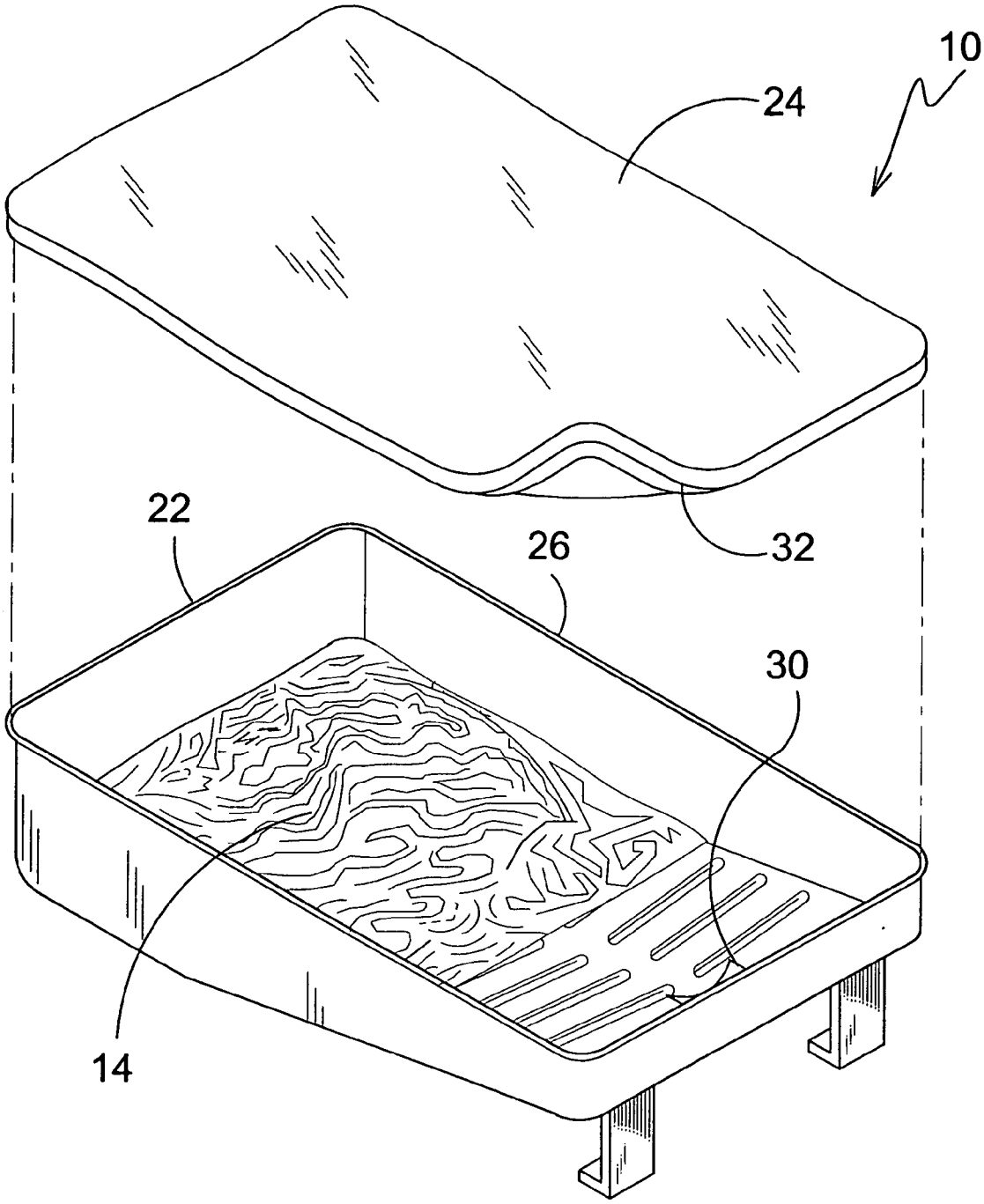
FIG. 4 is a perspective view of the present invention.

Turning to FIG. 4, shown therein is a perspective view of the present invention 10. Shown is the present invention 10 having a flexible soft plastic or rubber cover 24 having an outer circumference lip 32 that tightly correlates to and fits to the outer rim and lip 26 of the pan 22 whereby an attaching engagement can be made thereupon and around the formed lip to produce a seal impermeable to gas to thereby prevent exposure of the contained paint 14 to elements and conditions that would otherwise render the contained paint useless therefore preserving the contained paint and roller for future use. The handle flange 30 is also shown.

Figure 5:
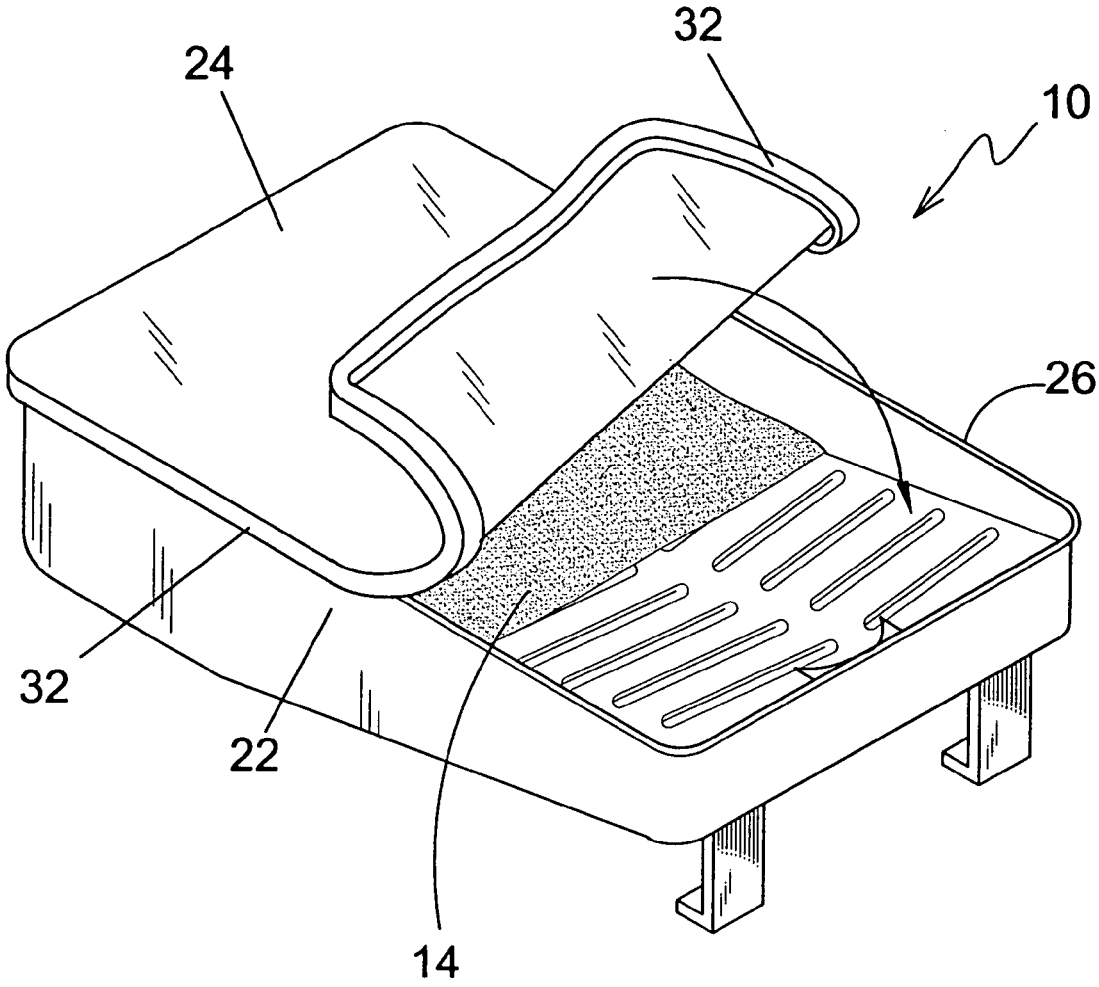
FIG. 5 is a perspective view of the present invention being installed.

Turning to FIG. 5, shown therein is a perspective view of the present invention 10 being installed. One of the primary advantages of the present invention 10 is that it is easily installed on the paint roller tray 22 by simply fitting the cover 24 over the paint roller pan and pressing along the edge until the two lips 26, 32 are completely engaged forming a fluid/air tight seal that allows for the preservation of the contained paint 14 for later use.

Figure 6:
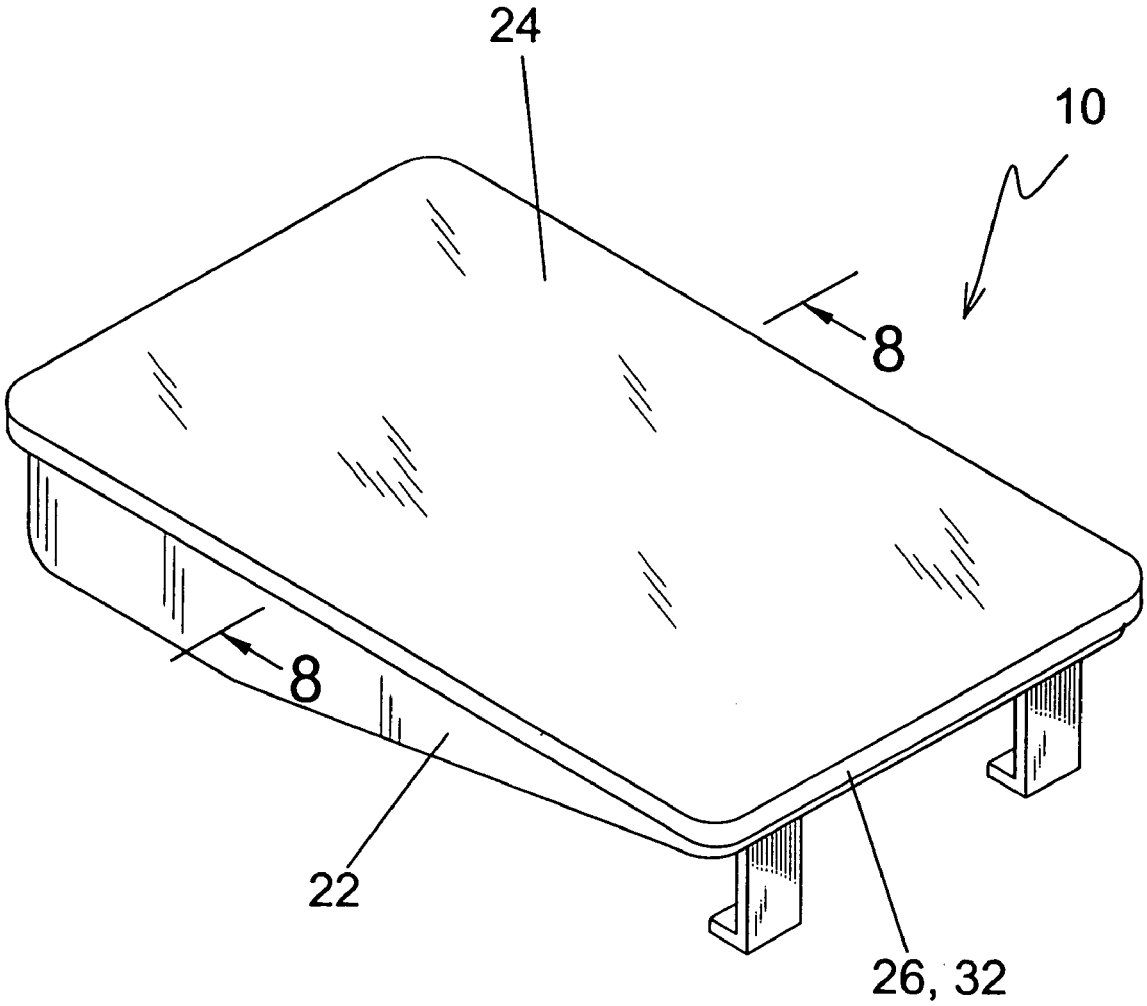
FIG. 6 is a perspective view of the present invention.

Turning to FIG. 6, shown therein is a perspective view of the present invention 10. Shown is the present invention 10 comprised of a deep-set paint pan 22 having a cover 24 manufactured with a lip 32 to form a fluid and/or air tight seal with the paint pan lip 26 whereby a quantity of paint can be stored for extended periods of time without the paint drying out.

Figure 7:
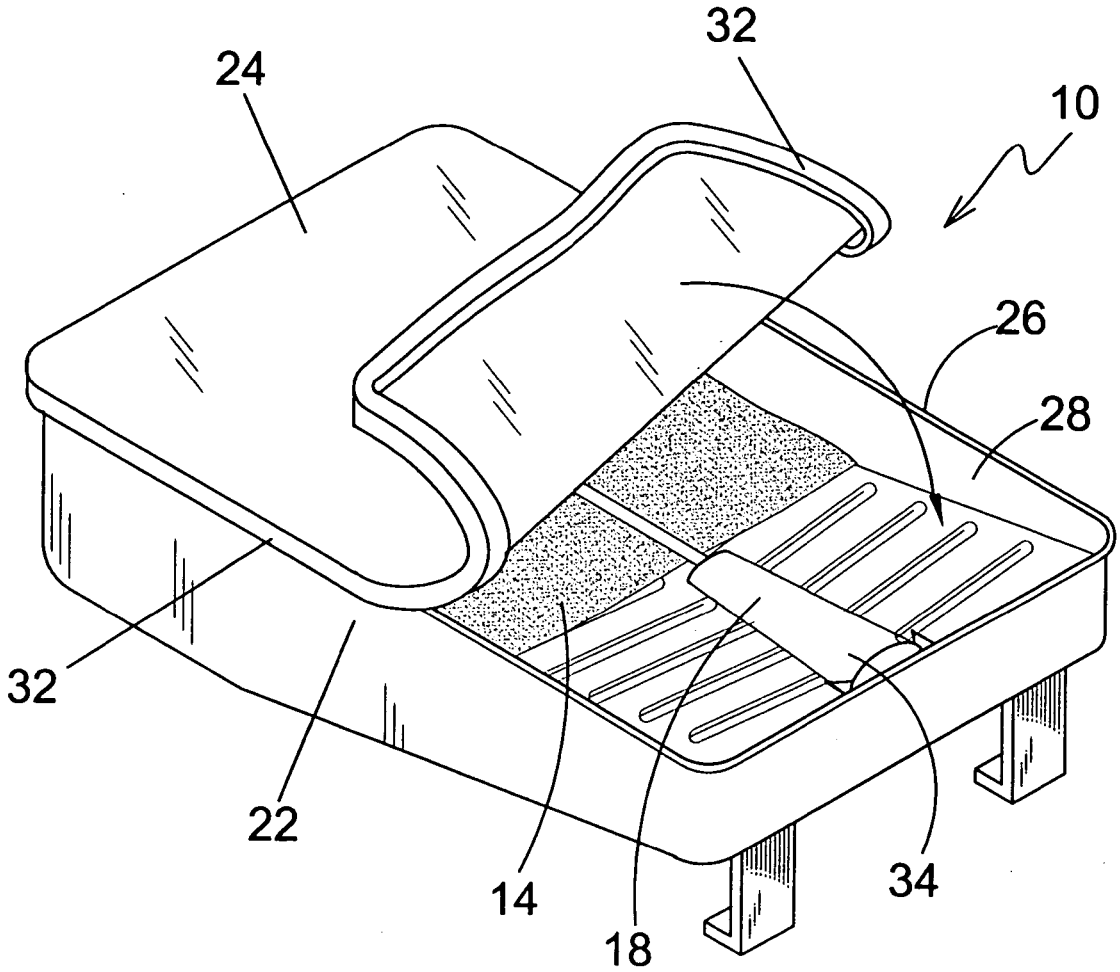
FIG. 7 is an illustrative view of the present invention having paint and roller therein.

Turning to FIG. 7, shown therein is an illustrative view of the present invention 10 having paint 14 and roller 18 therein. Shown is the present invention 10 having paint 14 and a roller 18 positioned therein whereby the paint roller pan 22 having a covering 24 with a lip 32 positioned on the periphery for engaging the lip 26 of the deep-set paint roller pan can be used to store the paint 14 and roller 18 in a fluid/air tight condition for an extended period of time. The deep-set paint tray 22 has a depth on the shallow end 28 exceeding the diameter of a paint roller handle 34 thereby providing means for positioning a paint roller 18 within the tray prior to sealing the cover 24 to the tray. Additionally, air can be expelled or evacuated from the interior by pressing downward on the middle on the middle portion of the cover 24 as the cover is snapped onto the deep-set paint roller pan lip 26.

Figure 8:
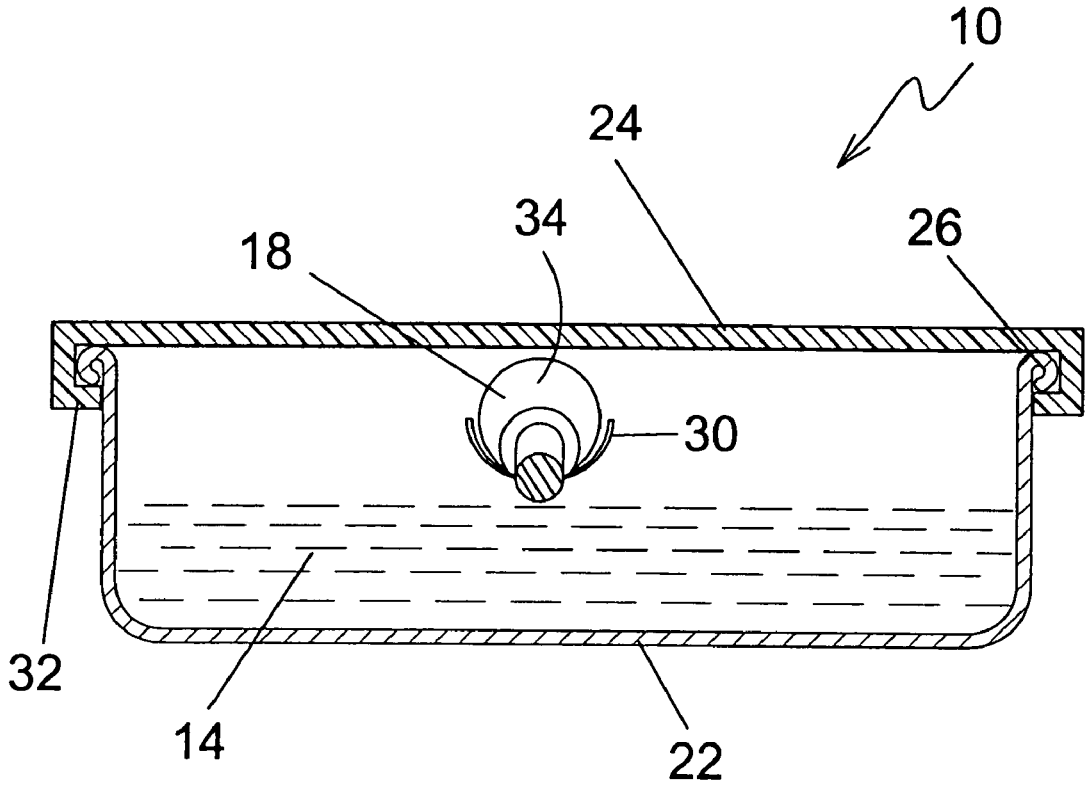
FIG. 8 is a sectional view of the present invention having paint and roller therein.

Turning to FIG. 8, shown therein is a sectional view of the present invention 10 having paint 14 and roller 18 therein. Shown is the present invention 10 comprising a paint roller pan 22 and a cover 24 having a lip 32 for engaging the lip 26 of the deep-set paint tray. The deep-set paint tray 22 has a depth on the shallow end exceeding the diameter of a paint roller handle 34 thereby providing means for positioning a paint roller 18 within the tray prior to engaging the cover 24 to the paint roller pan. Placement of the roller 18 within the pan 22 provides for the user the convenience of preserving the paint absorbed by the roller thereby saving the user the task of cleaning or rinsing the roller before a second later use. The upwardly concave handle flange 30 is also shown.

What is claimed is:

1. A deep paint roller pan for use with and in combination with paint and a paint roller, the paint roller having a handle thereon, the pan having a fitted cover, comprising:

a) said paint roller pan having a wall around its periphery, said paint roller pan having a first deep end and an opposing second shallow end contained within said wall, said paint roller pan having a first lip disposed on top of said wall;

b) wherein said deep end of said paint roller pan has a depth greater than the diameter of the paint roller to permit the paint roller to be completely contained within the paint roller pan;

c) wherein said shallow end of said paint roller pan has a depth greater than the diameter of the handle of the paint roller to permit the paint roller handle to be completely contained within the paint roller pan;

d) a rear section of said wall facing said shallow end of said paint roller pan having a concave flange for supporting the handle of said paint roller when said paint roller is resting within said paint roller pan, the wall of said paint roller pan being high enough to fully contain said paint roller when resting within said paint roller pan;

e) said cover being removably disposed on said paint roller pan, said cover being substantially planar, said cover being complementarily shaped as said wall of said paint roller pan, said cover having a second lip on the periphery thereof, said second lip of said cover mating to said first lip of said paint roller pan to permit said cover to tightly fit to said paint roller pan, said cover being sufficiently pliable to allow a center section thereof to be depressed prior to sealing said cover on said paint roller pan to expel excess air within said paint roller pan thereby allowing safe storage of said paint roller pan containing paint and said paint roller.

2. The apparatus of claim 1, wherein an impermeable seat is formed between said first lip and said second lip to prevent the paint in the paint roller pan from drying out.

3. The apparatus of claim 2, wherein said impermeable seal is impermeable to gas to prevent the paint in the paint roller pan from drying out.

4. The apparatus of claim 3, wherein said impermeable seal is impermeable to fluid to prevent the paint in the paint roller pan from drying out.

5. The apparatus of claim 4, wherein said cover comprises soft rubber.

6. The apparatus of claim 4, wherein said cover comprises soft plastic.

* * * * *